US011609034B2

(12) United States Patent
Cheon et al.

(10) Patent No.: US 11,609,034 B2
(45) Date of Patent: Mar. 21, 2023

(54) DEVICE FOR REMOVING FOREIGN MATTER IN ICE MAKER

(71) Applicant: DAEYEONG E&B Co., Ltd., Gyeonggi-do (KR)

(72) Inventors: Jae Yun Cheon, Gyeonggi-do (KR); Jae Hyuck Shin, Gyeonggi-do (KR)

(73) Assignee: BLUENIX CO., LTD, Gyeonggi-Do (KR)

( * ) Notice: Subject to any disclaimer, the term of this patent is extended or adjusted under 35 U.S.C. 154(b) by 65 days.

(21) Appl. No.: 17/003,781

(22) Filed: Aug. 26, 2020

(65) Prior Publication Data

US 2021/0278116 A1 Sep. 9, 2021

(30) Foreign Application Priority Data

Mar. 3, 2020 (KR) ..... 10-2020-0026648

(51) Int. Cl.
*F25C 1/04* (2018.01)

(52) U.S. Cl.
CPC ..... *F25C 1/04* (2013.01); *F25C 2400/14* (2013.01); *F25C 2700/04* (2013.01)

(58) Field of Classification Search
CPC .... F25C 1/04; F25C 2400/14; F25C 2700/04; F25C 1/12; F25C 1/25; F25D 31/001; G01F 23/30
See application file for complete search history.

(56) References Cited

U.S. PATENT DOCUMENTS

2020/0385959 A1* 12/2020 Zhang ..... E03B 11/02

FOREIGN PATENT DOCUMENTS

| | | | | | |
|---|---|---|---|---|---|
| JP | 2009002607 | A | * | 1/2009 | ..... F25C 5/187 |
| JP | 2009002607 | A | | 1/2009 | |
| JP | 2009138962 | A | | 6/2009 | |
| JP | 2017201887 | A | * | 11/2017 | |
| KR | 1020090109076 | A | | 10/2009 | |
| KR | 20130008760 | A | | 1/2013 | |
| KR | 101333546 | B1 | | 11/2013 | |
| KR | 20160095264 | A | * | 8/2016 | |

OTHER PUBLICATIONS

Translated Yoshida, Kazuhiro (Year: 2009).*
Translated Lee Hun Ju (Year: 2016).*
Translated_Hirofumi (Year: 2017).*

* cited by examiner

*Primary Examiner* — Elizabeth J Martin
*Assistant Examiner* — Samba NMN Gaye
(74) *Attorney, Agent, or Firm* — Dickinson Wright PLLC

(57) ABSTRACT

A device for removing foreign matter in an ice maker is configured to prevent foreign matter from accumulating on the bottom of a float by changing the structure of the bottom of the float. The device includes a level sensor sensing a water level using a float moving up and down, depending on a height of water supplied in a water tank and a connection pipe forming a channel for water flow between the water pump and the level sensor by being connected to the level sensor, and having an inclined surface inclined downward toward an entrance of the channel under the float.

3 Claims, 2 Drawing Sheets

DEVICE FOR REMOVING FOREIGN MATTER IN ICE MAKER

RELATED APPLICATIONS

The present application claims priority to Korean Patent Application No, 10-2020-0026648, filed Mar. 3, 2020, the entire contents of which is incorporated herein for all purposes by this reference.

FIELD

The present disclosure relates to a device for removing foreign matter in an ice maker, the device preventing foreign matter from accumulating under a float by changing the structure under the float.

BACKGROUND

An ice maker is a device that makes ice, and according to the process of making ice in the ice maker, a water supply process that fills a water tank with water from the outside through a water inlet valve is performed.

When the water tank is filled with water through this process, a water pump operates and water is supplied to an evaporator through a spray tube. In this process, a compressor operates and heat is exchanged between a refrigerant and water flowing down to the evaporator, whereby ice starts to be made.

As the ice grows, the level of the water in the water tank continuously decreases, and when ice making is finished, a level sensor indicates a low water level.

In this case, the ice maker determines that ice making is finished, and performs an ice separation process of separating the ice from the evaporator.

Next, when the ice is completely separated from the evaporator, the ice maker performs the ice making process again, whereby ice can be continuously made through continuous ice making and ice separation processes.

Further, the level sensor senses the water level in the water tank, a float of the level sensor moves up when the water level in the water tank increases while water is supplied, and the float moves down when the water level in the water tank decreases while ice is made. Further, when ice making is finished, a low water level is sensed by the level sensor, ice making is stopped, and the ice separation process is started.

Since the point in time when ice making is finished is sensed through the level sensor, the level sensor is one of important parts of the ice maker.

Accordingly, the level sensor should be designed to be able to accurately sense the water level in the water tank and should have a structure that can accurately sense a water level anytime regardless of the quality of water that is used.

However, we have discovered that when an ice maker operates in a poor-water quality environment, a large amount of foreign matter such as calcium accumulates around the level sensor, and when ice making is performed for a long time, the foreign matter interferes with the operation of the float. Accordingly, a low water level may not be sensed even though ice making is finished.

The description provided above as a related art of the present disclosure is just for helping understanding the background of the present disclosure and should not be construed as being included in the related art known by those skilled in the art.

BRIEF SUMMARY

The present disclosure has been made in an effort to solve the problems described above and an objective of the present disclosure is to provide a device for removing foreign matter in an ice maker, the device preventing foreign matter from accumulating under a float by changing the structure under the float.

In order to achieve the objectives of the present disclosure, a device for removing foreign matter in an ice maker includes: a level sensor sensing a water level using a float moving up and down, depending on a height of water supplied in a water tank; and a connection pipe forming a channel for water flow between the water pump and the level sensor by being connected to the level sensor, and having an inclined surface inclined downward toward an entrance of the channel under the float.

A first end of the connection pipe may be connected to a bottom of the level sensor, a middle portion of the connection pipe may be bent such that a second end of the connection pipe faces a side, and the inclined surface may be formed at an inner corner of the middle portion of the connection pipe.

An upper end of the inclined surface may be connected to an inner side of the first end of the connection pipe and a lower end of the inclined surface may be connected to a bottom of a portion where the connection pipe starts to bend from the first end to the second end.

The device may further include an exhauster discharging water to the inclined surface.

The exhauster may include a housing surrounding the float, an exhaust channel for exhausting inflow water may be formed by an inner side of the sensor housing, and an upper end of the inclined surface may be positioned right under the exhaust channel.

According to the present disclosure, since the inclined surface is formed in the section under the float and water is dropped for exhaust to the upper end of the inclined surface, calcium or foreign matter flow down along the inclined surface without accumulating under the float, so the float can smoothly operate and the water level in the water tank can be accurately detected.

BRIEF DESCRIPTION OF THE DRAWINGS

The above and other objects, features and other advantages of the present disclosure will be more clearly understood from the following detailed description when taken in conjunction with the accompanying drawings, in which.

DETAILED DESCRIPTION

Figure 1:
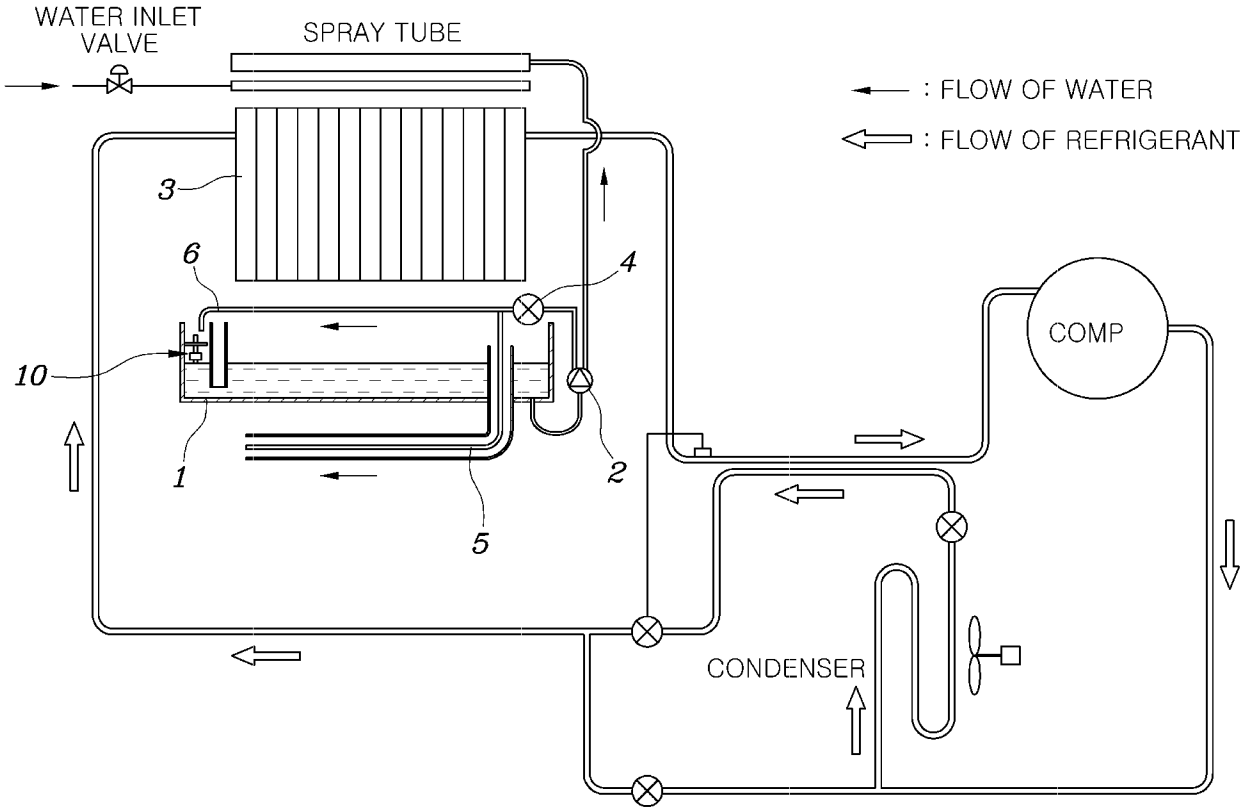
FIG. 1 is a view showing the entire system configuration of an ice maker according to the present disclosure.

Exemplary embodiments of the present disclosure are described hereafter in detail with reference to the accompanying drawings.

In the following description, the structural or functional description specified to exemplary embodiments according to the concept of the present disclosure is intended to describe the exemplary embodiments, so it should be understood that the present disclosure may be variously embodied, without being limited to the exemplary embodiments.

Embodiments described herein may be changed in various ways and various shapes, so specific embodiments are shown in the drawings and will be described in detail in this specification. However, it should be understood that the exemplary embodiments according to the concept of the present disclosure are not limited to the embodiments which will be described hereinbelow with reference to the accompanying drawings, but all of modifications, equivalents, and substitutions are included in the scope and spirit of the present disclosure.

It will be understood that, although the terms first, second, etc. may be used herein to describe various elements, but these elements should not be limited by these terms. These terms are only used to distinguish one element, from another element. For instance, a first element discussed below could be termed a second element without departing from the teachings of the present disclosure. Similarly, the second element could also be termed the first element.

It is to be understood that when one element is referred to as being "connected to" or "coupled to" another element, it may be connected directly to or coupled directly to another element or be connected to or coupled to another element, having the other element intervening therebetween. On the other hand, it is to be understood that when one element is referred to as being "connected directly to" or "coupled directly to" another element, it may be connected to or coupled to another element without the other element intervening therebetween. Further, the terms used herein to describe a relationship between elements, that is, "between", "directly between", "adjacent" or "directly adjacent" should be interpreted in the same manner as those described above.

Terms used in the present disclosure are used only in order to describe specific exemplary embodiments rather than limiting the present disclosure. Singular forms are intended to include plural forms unless the context clearly indicates otherwise. It will be further understood that the terms "comprises" or "have" used in this specification, specify the presence of stated features, steps, operations, components, parts, or a combination thereof, but do not preclude the presence or addition of one or more other features, numerals, steps, operations, components, parts, or a combination thereof.

Unless otherwise defined, all terms including technical and scientific terms used herein have the same meaning as commonly understood by those skilled in the art to which the present disclosure belongs. It must be understood that the terms defined by the dictionary are identical with the meanings within the context of the related art, and they should not be ideally or excessively formally defined unless the context clearly dictates otherwise.

Figure 2:
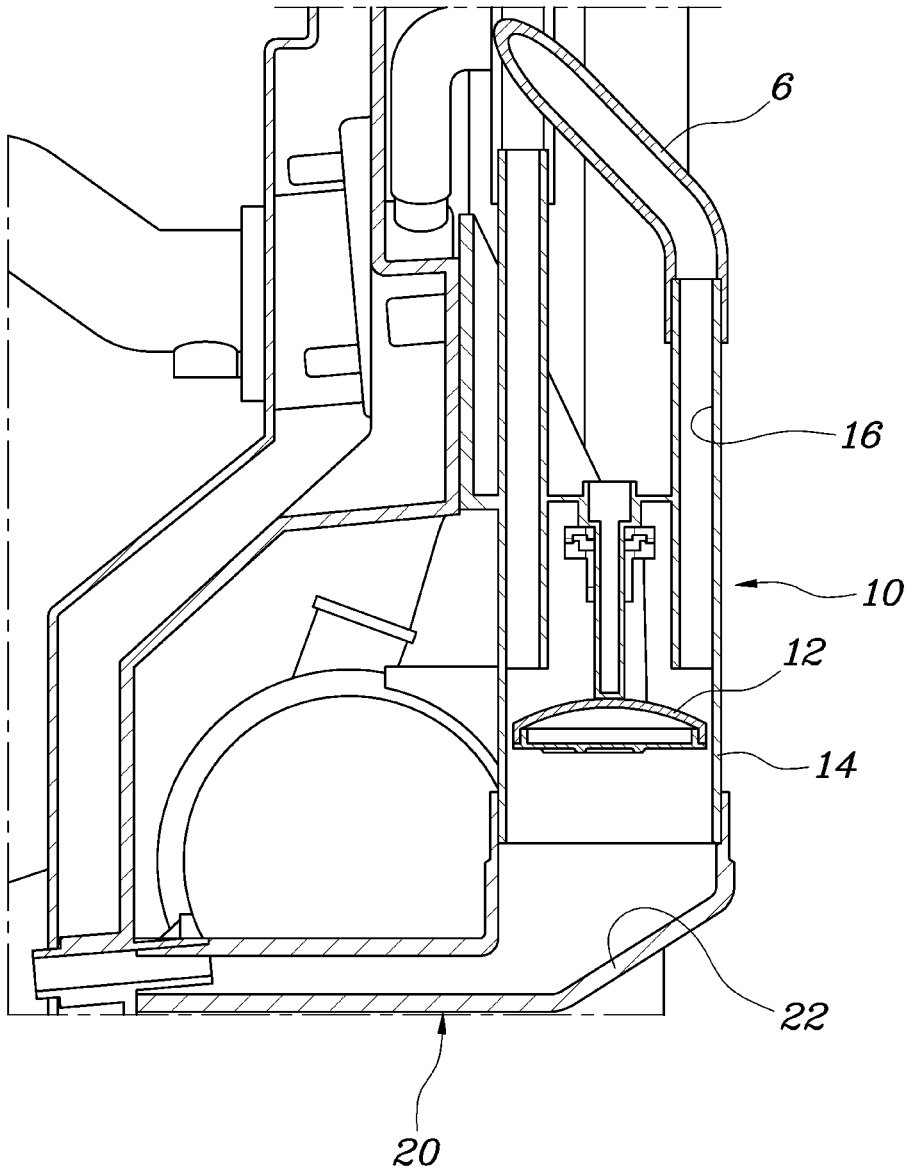
FIG. 2 is an enlarged view showing a level sensor according to the present disclosure.

FIG. 1 is a view showing the entire system configuration of an ice maker according to the present disclosure and FIG. 2 is an enlarged view showing a level sensor 10 according to the present disclosure.

Referring to the figures, a device for removing foreign matter in an ice maker of the present disclosure includes: a level sensor 10 sensing a water level using a float 12 moving up and down, depending on the height of water supplied in a water tank 1; and a connection pipe 20 forming a channel for water flow between the water pump 2 and the level sensor 10 by being connected to the level sensor 10, and having an inclined surface 22 inclined downward toward an entrance of the channel under the float 12.

For example, the water tank 1 and the level sensor 10 are connected by the connection pipe 20, so water in the water tank 1 and the water in the level sensor 10 are connected to each other.

Accordingly, when the water in the water tank 1 increases or decreases in volume, the height of the water in the level sensor 10 changes and the float 12 moves up or down, whereby the water level in the water tank 1 can be detected.

However, in the related art, the connection pipe 20 disposed under the float 12 is flat, so calcium and other foreign matter contained in water accumulate under the float 12 and interfere with the float 12 moving down, thereby causing a problem that an error is generated in measurement of the water level in the water tank 1.

Accordingly, in the present disclosure, the connection pipe 20 disposed under the float 12 is inclined downward toward the water tank 1, so calcium or foreign matter flow down along the inclined surface 22 without accumulating. Therefore, the float 12 can smoothly move up and down and the water level in the water tank 1 can be accurately detected.

The structure of the connection pipe 20 is described in more detail. A first end of the connection pipe 20 is connected to the bottom of the level sensor 10, the middle portion of the connection pipe 20 is bent in an L-shape, and a second end of the connection pipe 20 faces a side. Further, the inclined surface 22 is formed at the inner corner of the middle portion of the connection pipe 20.

For example, the first end of the connection pipe 20 faces up to communicate with the bottom of the level sensor 10 and the second end of the connection pipe 20 faces a side to communication with the water tank 1 with the middle portion of the connection pipe 20 therebetween. The inclined surface 22 is formed on the bottom of the middle portion bending from the first end to the second end of the connection pipe 20.

The upper end of the inclined surface 22 is connected to the inner side of the first end of the connection pipe 20 and the lower end of the inclined surface 22 is connected to the bottom of the portion where the connection pipe 20 starts to bend from the first end to the second end.

That is, the inclined surface 22 is formed in the entire section under the float 12, so there is no flat portion under the float 12, thereby fundamentally preventing calcium or foreign matter from accumulating under the float 12.

Meanwhile, the present disclosure further includes an exhauster for discharging water to the inclined surface 22.

In detail, the exhauster has a sensor housing 14 surrounding the float 12, an exhaust channel 16 for exhausting inflow water is formed by the inner side of the sensor housing 14, and the upper end of the inclined surface 22 is positioned right under the exhaust channel 16.

The exhaust channel 16 is connected with an assistant exhaust pipe 6 connected with the water pump 2, so water in the assistant exhaust pipe 6 is sent to the exhaust channel 16 and then discharged by the operation of the water pump 2.

In the ice maker of the present disclosure, exhaust is performed with a predetermined cycle to discharge the low-level water in the water tank 1 by the water pump 2.

To this end, the water pump 2 operates forward and supplies water to the evaporator 3 in ice making, but the water pump 2 operates backward in exhausting and a check valve 4 opens, whereby the water in the water tank 1 is discharged through an overflow pipe 5 and the exhaust channel 16.

Accordingly, the water that has passed through the check valve 4 flows into the overflow pipe 5 and the assistant exhaust pipe 6 and then the water flowing in the assistant exhaust pipe 6 flows into the connection pipe 20 through the exhaust channel 16, whereby the water in the water tank 1 waves and the water is discharged with foreign matter floated from a low level.

In particular, in the present disclosure, the water discharged through the exhaust channel 16 drops to the upper end of the inclined surface, whereby calcium or foreign matter remaining on the inclined surface 22 are swept away. Accordingly, accumulation of foreign matter under the float 12 is further prevented and the reliability in the operation of the level sensor 10 is also improved.

Although the present disclosure was described with reference to the detailed embodiments, it is apparent to those skilled in the art that the present disclosure may be changed and modified in various ways without the scope of the present disclosure and it should be noted that the changes and modifications are included in claims.

The invention claimed is:

1. A device for removing foreign matter in an ice maker having a water pump, the device comprising:

a level sensor sensing a water level using a float moving up and down, depending on a height of water supplied in a water tank; and a connection pipe forming a channel for water flow between the water pump and the level sensor by being connected to the level sensor, and having an inclined surface inclined downward toward an entrance of the channel under the float;

wherein a first end of the connection pipe is connected to a bottom of the level sensor, a middle portion of the connection pipe is bent such that a second end of the connection pipe faces a side, and the inclined surface is formed at an inner corner of the middle portion of the connection pipe;

wherein an upper end of the inclined surface is connected to an inner side of the first end of the connection pipe and a lower end of the inclined surface is connected to a bottom of a portion where the connection pipe starts to bend from the first end to the second end.

2. The device of claim 1, further comprising an exhauster discharging water to the inclined surface.

3. The device of claim 2, wherein the exhauster comprises a sensor housing surrounding the float, an exhaust channel for exhausting inflow water is formed by an inner side of the sensor housing, and an upper end of the inclined surface is positioned right under the exhaust channel.

* * * * *